US007470182B2

(12) United States Patent
Martinek et al.

(10) Patent No.: US 7,470,182 B2
(45) Date of Patent: Dec. 30, 2008

(54) COMPUTERIZED GAMING SYSTEM, METHOD AND APPARATUS

(75) Inventors: Michael G. Martinek, Fort Collins, CO (US); Mark D. Jackson, Fort Collins, CO (US); Mark L. Yoseloff, Henderson, NV (US)

(73) Assignee: IGT, Reno, NV (US)

( * ) Notice: Subject to any disclaimer, the term of this patent is extended or adjusted under 35 U.S.C. 154(b) by 628 days.

(21) Appl. No.: 10/827,042

(22) Filed: Apr. 19, 2004

(65) Prior Publication Data

US 2004/0198479 A1 Oct. 7, 2004

Related U.S. Application Data

(62) Division of application No. 09/520,405, filed on Mar. 8, 2000.

(51) Int. Cl.
*A63F 9/22* (2006.01)

(52) U.S. Cl. ..... 463/16; 463/40

(58) Field of Classification Search ..... 463/1, 463/24–25, 29, 16–20, 43, 46; 273/138.1, 273/138.2, 139, 143 R, 269; 707/202; 714/100, 714/112, 5, 6, 15, 21, 36, 42; 700/1, 11, 700/19; 709/328, 330, 331, 332; 710/8, 710/10, 15, 17, 19, 62, 63; 717/1, 3
See application file for complete search history.

(56) References Cited

U.S. PATENT DOCUMENTS

| | | | |
|---|---|---|---|
| 3,825,905 | A | 7/1974 | Allen, Jr. |
| 3,838,264 | A | 9/1974 | Maker |
| 3,931,504 | A | 1/1976 | Jacoby |
| 4,072,930 | A | 2/1978 | Lucero et al. |
| 4,193,131 | A | 3/1980 | Lennon et al. |
| 4,200,770 | A | 4/1980 | Hellman et al. |
| 4,218,582 | A | 8/1980 | Hellman et al. |

(Continued)

FOREIGN PATENT DOCUMENTS

| | | |
|---|---|---|
| DE | 37 00 861 | 7/1988 |

(Continued)

OTHER PUBLICATIONS

Retro Fitting a Low-Boy Arcade Machine with a Pentium-Powered M.A.M.E.

(Continued)

*Primary Examiner*—Robert E Pezzuto
(74) *Attorney, Agent, or Firm*—Beyer Weaver LLP

(57) ABSTRACT

The present invention in various embodiments provides a computerized wagering game method and apparatus that features an operating system kernel, a system handler application that loads and executes gaming program shared objects and features nonvolatile storage that facilitates sharing of information between gaming program objects. The system handler of some embodiments further provides an API library of functions callable from the gaming program objects, and facilitates the use of callback functions on change of data stored in nonvolatile storage. The nonvolatile storage also provides a nonvolatile record of the state of the computerized wagering game, providing protection against loss of the game state due to power loss. The system handler application in various embodiments includes a plurality of device handlers, providing an interface to selected hardware and the ability to monitor hardware-related events.

14 Claims, 2 Drawing Sheets

U.S. PATENT DOCUMENTS 4,250,563 A 2/1981 Struger
4,293,928 A 10/1981 Baun
4,354,251 A 10/1982 Hellwig et al.
4,355,390 A 10/1982 Hellwig et al.
4,405,829 A 9/1983 Rivest et al.
4,430,728 A 2/1984 Beitel et al.
4,454,594 A 6/1984 Heffron et al.
4,458,315 A 7/1984 Uchenick
4,462,076 A 7/1984 Smith, III
4,467,424 A 8/1984 Hedges et al.
4,494,114 A 1/1985 Kaish et al.
4,500,933 A 2/1985 Chan
4,519,077 A 5/1985 Amin
4,525,599 A 6/1985 Curran et al.
4,582,324 A 4/1986 Koza et al.
4,607,844 A 8/1986 Fullerton
4,652,998 A 3/1987 Koza et al.
4,658,093 A 4/1987 Hellman
4,683,550 A 7/1987 Jindrick et al.
4,727,544 A * 2/1988 Brunner et al. ..... 463/29
4,752,068 A 6/1988 Endo
4,757,505 A 7/1988 Marrington et al.
4,759,064 A 7/1988 Chaum
4,817,140 A 3/1989 Chandra et al.
4,837,728 A 6/1989 Barrie et al.
4,845,715 A 7/1989 Francisco
4,848,744 A 7/1989 Steininger et al.
4,856,787 A 8/1989 Itkis
4,862,355 A 8/1989 Newman et al.
4,865,321 A 9/1989 Nakagawa et al.
4,911,449 A 3/1990 Dickinson et al.
4,930,073 A 5/1990 Cina, Jr.
4,944,008 A 7/1990 Piosenka et al.
4,951,149 A 8/1990 Faroudja
4,972,470 A 11/1990 Farago
5,004,232 A 4/1991 Wong et al.
5,021,772 A 6/1991 King et al.
5,050,212 A 9/1991 Dyson
5,103,081 A 4/1992 Fisher et al.
5,109,152 A 4/1992 Takagi et al.
5,146,575 A 9/1992 Nolan
5,155,680 A 10/1992 Wiedemer
5,155,768 A 10/1992 Matsuhara
5,155,856 A 10/1992 Bock et al.
5,161,193 A 11/1992 Lampson et al.
5,179,517 A 1/1993 Sarbin
5,224,160 A 6/1993 Paulini et al.
5,235,642 A 8/1993 Wobber et al.
5,259,613 A 11/1993 Marnell
5,264,958 A 11/1993 Johnson
5,283,734 A 2/1994 Von Kohorn
5,288,978 A 2/1994 Iijima
5,291,585 A 3/1994 Sato et al.
5,297,205 A 3/1994 Audebert et al.
5,326,104 A 7/1994 Pease et al.
5,342,047 A 8/1994 Heidel et al.
5,343,527 A 8/1994 Moore
5,353,411 A 10/1994 Nakaosa et al.
5,375,241 A 12/1994 Walsh
5,379,431 A * 1/1995 Lemon et al. ..... 710/10
5,394,547 A 2/1995 Correnti et al.
5,398,932 A 3/1995 Eberhardt et al.
5,400,246 A 3/1995 Wilson et al.
5,421,006 A 5/1995 Jablon et al.
5,428,525 A 6/1995 Cappelaere et al.
5,429,361 A 7/1995 Raven et al.
5,444,642 A 8/1995 Montgomery et al.
5,465,364 A 11/1995 Lathrop et al.
5,469,571 A 11/1995 Bunnett et al.
5,473,765 A 12/1995 Gibbons et al.
5,488,702 A 1/1996 Byers et al.
5,489,095 A 2/1996 Goudard et al.
5,497,490 A 3/1996 Harada et al.
5,507,489 A 4/1996 Reibel et al.
5,508,689 A 4/1996 Rado et al.
5,542,669 A 8/1996 Charron et al.
5,548,782 A 8/1996 Michael et al.
5,553,290 A 9/1996 Calvert
5,568,602 A 10/1996 Callahan et al.
5,575,717 A 11/1996 Houriet et al.
5,586,766 A 12/1996 Forte et al.
5,586,937 A 12/1996 Menashe
5,594,903 A 1/1997 Bunnell et al.
5,604,801 A 2/1997 Dolan et al.
5,611,730 A 3/1997 Weiss
5,634,058 A 5/1997 Allen et al.
5,643,086 A 7/1997 Alcorn et al.
5,644,704 A 7/1997 Pease et al.
5,655,965 A 8/1997 Takemoto et al.
5,664,187 A 9/1997 Burkes et al.
5,668,945 A 9/1997 Ohba et al.
5,671,351 A 9/1997 Wild et al.
5,688,174 A 11/1997 Kennedy
5,702,303 A 12/1997 Takemoto et al.
5,704,835 A 1/1998 Dietz, II
5,707,286 A 1/1998 Carlson
5,725,428 A 3/1998 Achmuller
5,737,418 A 4/1998 Saffari et al.
5,742,616 A 4/1998 Torreiter et al.
5,742,825 A 4/1998 Mathur et al.
5,752,882 A 5/1998 Acres et al.
5,758,875 A 6/1998 Giacalone, Jr.
5,759,102 A 6/1998 Pease et al.
5,761,647 A 6/1998 Boushy
5,768,382 A 6/1998 Schneier et al.
5,778,226 A 7/1998 Adams et al.
5,800,268 A 9/1998 Molnick
5,809,329 A 9/1998 Lichtman et al.
5,823,874 A 10/1998 Adams
5,848,250 A 12/1998 Smith et al.
5,848,932 A 12/1998 Adams
5,851,149 A 12/1998 Xidos et al.
5,863,041 A 1/1999 Boylan et al.
5,870,587 A 2/1999 Danforth et al.
5,871,400 A 2/1999 Yfantis
5,872,973 A 2/1999 Mitchell et al.
5,879,234 A 3/1999 Mengual
5,889,990 A 3/1999 Coleman et al.
5,893,121 A 4/1999 Ebrahim et al.
5,901,319 A 5/1999 Hirst
5,934,672 A 8/1999 Sines et al.
5,935,224 A 8/1999 Svancarek et al.
5,944,821 A * 8/1999 Angelo ..... 726/22
5,954,583 A 9/1999 Green
5,970,143 A 10/1999 Schneier et al.
5,971,851 A * 10/1999 Pascal et al. ..... 463/24
5,980,384 A 11/1999 Barrie
5,984,786 A 11/1999 Ehrman
5,991,399 A 11/1999 Graunke et al.
5,991,546 A 11/1999 Chan et al.
5,995,745 A 11/1999 Yodaiken
5,999,990 A 12/1999 Sharrit et al.
6,003,038 A 12/1999 Chen
6,006,279 A 12/1999 Hayes
6,014,714 A 1/2000 Plyler et al.
6,015,344 A 1/2000 Kelly et al.
6,021,414 A 2/2000 Fuller
6,026,238 A 2/2000 Bond et al.
6,035,321 A 3/2000 Mays
6,039,645 A 3/2000 Mazur
6,044,428 A 3/2000 Rayabhari
6,044,471 A 3/2000 Colvin
6,052,778 A * 4/2000 Hagy et al. ..... 713/2
6,071,190 A 6/2000 Weiss et al.

| | | | |
|---|---|---|---|
| 6,075,939 | A | 6/2000 | Bunnell et al. |
| 6,099,408 | A | 8/2000 | Schneier et al. |
| 6,102,796 | A | 8/2000 | Pajitnov et al. |
| 6,104,815 | A | 8/2000 | Alcorn et al. |
| 6,104,859 | A | 8/2000 | Yoshida et al. |
| 6,106,396 | A | 8/2000 | Alcorn et al. |
| 6,117,010 | A | 9/2000 | Canterbury et al. |
| 6,126,548 | A | 10/2000 | Jacobs et al. |
| 6,134,677 | A | 10/2000 | Lindsay |
| 6,135,884 | A | 10/2000 | Hedrick et al. |
| 6,135,887 | A | 10/2000 | Pease et al. |
| 6,149,522 | A | 11/2000 | Alcorn et al. |
| 6,165,072 | A | 12/2000 | Davis et al. |
| 6,181,336 | B1 | 1/2001 | Chiu et al. |
| 6,185,678 | B1 | 2/2001 | Arbaugh et al. |
| 6,195,587 | B1 | 2/2001 | Hruska et al. |
| 6,203,427 | B1 | 3/2001 | Walker et al. |
| 6,210,274 | B1 | 4/2001 | Carlson |
| 6,214,495 | B1 | 4/2001 | Segawa et al. |
| 6,215,495 | B1 | 4/2001 | Grantham et al. |
| 6,222,448 | B1 | 4/2001 | Beck et al. |
| 6,222,529 | B1 | 4/2001 | Ouatu-Lascar et al. |
| 6,224,482 | B1 | 5/2001 | Bennett |
| 6,251,014 | B1 | 6/2001 | Stockdale et al. |
| 6,253,374 | B1 | 6/2001 | Dresevic et al. |
| 6,263,392 | B1 | 7/2001 | McCauley |
| 6,264,557 | B1 | 7/2001 | Schneier et al. |
| 6,269,474 | B1 | 7/2001 | Price |
| 6,279,124 | B1 | 8/2001 | Brouwer et al. |
| 6,290,602 | B1 | 9/2001 | Kawano |
| 6,319,125 | B1 | 11/2001 | Acres |
| 6,322,445 | B1 | 11/2001 | Miller |
| 6,324,605 | B1 | 11/2001 | Rafferty et al. |
| 6,327,605 | B2 | 12/2001 | Arakawa et al. |
| 6,331,146 | B1 | 12/2001 | Miyamoto et al. |
| 6,364,769 | B1 | 4/2002 | Weiss et al. |
| 6,368,219 | B1 | 4/2002 | Szrek et al. |
| 6,379,246 | B1 | 4/2002 | Dabrowski |
| 6,394,907 | B1 | 5/2002 | Rowe |
| 6,401,208 | B2 | 6/2002 | Davis et al. |
| 6,409,602 | B1 * | 6/2002 | Wiltshire et al. ..... 463/42 |
| 6,446,211 | B1 | 9/2002 | Colvin |
| 6,446,257 | B1 | 9/2002 | Pradhan et al. |
| 6,449,687 | B1 | 9/2002 | Moriya |
| 6,453,319 | B1 | 9/2002 | Mattis et al. |
| 6,454,648 | B1 | 9/2002 | Kelly et al. |
| 6,460,142 | B1 | 10/2002 | Colvin |
| 6,484,264 | B1 | 11/2002 | Colvin |
| 6,496,808 | B1 | 12/2002 | Aiello et al. |
| 6,502,195 | B1 | 12/2002 | Colvin |
| 6,505,087 | B1 | 1/2003 | Lucas et al. |
| 6,510,521 | B1 | 1/2003 | Albrecht et al. |
| 6,527,638 | B1 | 3/2003 | Walker et al. |
| 6,577,733 | B1 | 6/2003 | Charrin |
| 6,595,856 | B1 | 7/2003 | Ginsburg et al. |
| 6,620,047 | B1 | 9/2003 | Alcorn et al. |
| 6,671,745 | B1 * | 12/2003 | Mathur et al. ..... 719/328 |
| 6,785,825 | B2 | 8/2004 | Colvin |
| 6,792,548 | B2 | 9/2004 | Colvin |
| 6,795,928 | B2 | 9/2004 | Bradley et al. |
| 6,799,277 | B2 | 9/2004 | Colvin |
| 6,804,763 | B1 | 10/2004 | Stockdale et al. |
| 6,805,634 | B1 | 10/2004 | Wells et al. |
| 6,813,717 | B2 | 11/2004 | Colvin |
| 6,813,718 | B2 | 11/2004 | Colvin |
| 6,851,607 | B2 | 2/2005 | Orus et al. |
| 6,857,078 | B2 | 2/2005 | Colvin et al. |
| 6,908,391 | B2 | 6/2005 | Gatto et al. |
| 6,935,946 | B2 | 8/2005 | Yoseloff |
| 6,978,465 | B2 | 12/2005 | Williams |
| 6,988,267 | B2 | 1/2006 | Harris et al. |
| 7,063,615 | B2 | 6/2006 | Alcorn et al. |
| 2001/0003709 | A1 | 6/2001 | Adams |
| 2001/0044339 | A1 | 11/2001 | Cordero |
| 2001/0053712 | A1 | 12/2001 | Yoseloff |
| 2002/0049909 | A1 | 4/2002 | Jackson et al. |
| 2002/0052230 | A1 | 5/2002 | Martinek et al. |
| 2002/0116284 | A1 | 8/2002 | Steelman et al. |
| 2002/0151363 | A1 | 10/2002 | Letovsky et al. |
| 2003/0014639 | A1 | 1/2003 | Jackson et al. |
| 2003/0069074 | A1 | 4/2003 | Jackson |
| 2003/0078103 | A1 | 4/2003 | LeMay et al. |
| 2003/0195033 | A1 | 10/2003 | Gazdic et al. |
| 2003/0203755 | A1 | 10/2003 | Jackson |
| 2003/0203756 | A1 | 10/2003 | Jackson |
| 2003/0224858 | A1 | 12/2003 | Yoseloff et al. |
| 2004/0038740 | A1 | 2/2004 | Muir |
| 2004/0043184 | A1 | 3/2004 | Angel et al. |
| 2004/0043814 | A1 | 3/2004 | Angell et al. |
| 2004/0072611 | A1 | 4/2004 | Wolf et al. |
| 2004/0198494 | A1 | 10/2004 | Nguyen et al. |
| 2006/0287098 | A1 | 12/2006 | Morrow et al. |

FOREIGN PATENT DOCUMENTS

| | | |
|---|---|---|
| DE | 40 14 477 | 7/1991 |
| EP | 0 317 477 | 5/1989 |
| EP | 0 685 246 | 12/1995 |
| EP | 0 762 302 | 3/1997 |
| EP | 0 798 634 | 10/1997 |
| EP | 0 950 998 | 10/1999 |
| EP | 0 953 930 | 11/1999 |
| EP | 0 996 058 | 4/2000 |
| EP | 1 255 234 | 6/2002 |
| GB | 2 072 395 | 9/1981 |
| GB | 2 121 569 | 12/1983 |
| GB | 2 147 773 | 5/1985 |
| GB | 2 201 821 | 9/1988 |
| GB | 2 202 984 | 10/1988 |
| GB | 2253325 | 9/1992 |
| WO | 94/19784 | 9/1994 |
| WO | 96/00939 | 1/1996 |
| WO | 96/00950 | 1/1996 |
| WO | 96/14614 | 5/1996 |
| WO | 98/00207 | 1/1998 |
| WO | 98/20417 | 5/1998 |
| WO | 99/09474 | 2/1999 |
| WO | 99/49394 | 9/1999 |
| WO | WO 99/49394 | 9/1999 |
| WO | 99/65579 | 12/1999 |
| WO | WO-9965579 | * 12/1999 |
| WO | 00/33196 | 6/2000 |
| WO | 01/22267 | 3/2001 |
| WO | 02/073501 | 9/2002 |

OTHER PUBLICATIONS

Setup, Oct. 1996, www.cygnus.uwa.edu/au/~jaycode/jaw/arcade.html.

Australian Office Action dated Dec. 12, 2005, from related Australian Application No. 2001245518 (2 pages).

Answer and Counterclaims to Second Amended Complaint filed in connection with Civil Action No. CV-S-0 1-1498, pp. 1-26 and certificate of service page.

Defendants', Supplemental Response to Plaintiffs' First Set of Interrogatories filed in connection with Civil Action No. CV-S-01-1497, pp. 1-3,50-68 and 85-86.

Davida, G. et al., "Defending Systems Against Viruses through Cryptographic Authentication," Proceedings of the Symposium on Security and Privacy, *IEEE Comp. Soc. Press*, pp. 312-318 (May 1, 1989).

Document entitled: "Fact Sheet on Digital Signature Standard" dated May 1994, 6 pages.

Federal Information Processing Standards (FIPS) Publication 180-1 entitled: "Secure Hash Standard" dated Apr. 17, 1995, 2 title pages, abstract page and pp. 1-21.

Federal Information Processing Standards (FIPS) Publication 180 entitled: "Secure Hash Standard" dated May 11, 1993, title page, abstract page, and pp. 1-20.
Federal Information Processing Standards (FIPS) Publication 186 entitled: "Digital Signature Standard (DSS)" dated May 19, 1994, 17 pages.
Hellman, Martin E., "The Mathematics of Public-Key Cryptography," Scientific American, vol. 241, No. 8, Aug. 1979, pp. 146-152 and 154-157.
Rivest, et al., "A Method for Obtaining Digital Signatures and Public-Key Cryptosystems," Communications of the ACM vol. 21, No. 2, Feb. 1978, pp. 120-126.
Bauspiess, et al., "Requirements For Cryptographic Hash Functions," *Computers and Security*, 5:427-437 (Sep. 11, 1992).
Complaint for patent infringement filed by Aristocrat Technologies, et al., dated Jan. 22, 2002, Civil Action No. CV-S-02-0091.
Bakhtiari et al., Cryptographic Hash Functions: A Survey, 1995, Centre for Computer Security Research, pp. 1-26.
Schneier, B.: "Applied Cryptography, Second Edition. Protocols, Algorithms, and Source Code in C" 1996, John Wiley & Sons, Inc. USA, XP002344241, pp. 446-449; pp. 458-459.
Menezes A., Van Oorschot P., Vanstone S.: "Handbook of Applied Cryptography" 1996, CRC Press, USA, XP002344242, pp. 365-366.
European Office Action dated Dec. 8, 2005 from a related EP Application No. 02768907.4 4 pages.
Game Programming Gems, Mark DeLourna, Charles River Media, ISBN: 1-584050-049-2, 2000 (12 pages).
DirectX Media: Multimedia Services for Microsoft Internet Explorer and Microsoft Windows, MSDN Library, http://msdn.microsoft.com, Oct. 1998 (10 pages).
Levinthal, Adam and Barnett, Michael "The Silicon Gaming Odyssey Slot Machine," Feb. 1997, COMPCON '97 Proceedings, IEEE San Jose, CA; IEEE Comput. Soc., pp. 296-301.
Bernardi, Fabricc et al., "Model Design Using Hierarchical Web-Based Libraries", Jun. 10-14, 2002, Annual ACM IEEE Design Automation Conference, New Orleans, Louisiana, pp. 14-17.
WinSystems, http://www.webarchive.org/web/19881212034126/http://winsystems.com/ (Dec. 12, 1998), downloaded from the internet on Oct. 27, 2003, all pages.
RTD USA, http://www.webarchive.org.web/1990422091026/-http://rtdusa.com/ (Apr. 22, 1999), downloaded from the internet on Oct. 27, 2003, all pages.
Mardsen, et al. Development of a PC-Windows Based Universal Control System, 5th Intl. Conf. on Factory 2000, Apr. 2-4, 1997, Conf. Pub. No. 435, pp. 284-287.
RTD USA, www.rtdusa.com (1998), downloaded from the Internet on Mar. 30, 2003, pp. 1-49.
Final Office Action mailed Mar. 7, 2007 from corresponding U.S. Appl. No. 09/520,405 10 pages.
Final Office Action mailed Feb. 7, 2007 from corresponding U.S. Appl. No. 10/182,469 10 pages.
Supplementary Partial European Search Report from Corresponding Foreign Application No. 01918453.0 -2221, dated Apr. 17, 2007, 6 pages.
Bovet D P et al: "Understanding the Linux Kernel" Jan. 2001, pp. 1-34, XP002332389.
European Search Report from Corresponding Foreign Application No. 02775968.7, dated Oct. 13, 2006, 3 pages.
Objecet-Oriented Programming Concepts, Sun Microsystems, Inc. (2002).
Terry Monlick, What is Object-Oriented Software, Software Design Concultants, LLC 1999.
OnCore Systems www.oncoresystems.com 1999.
Encyclopedia www.encyclopedia.com 2002.
Michael Tiemann, "Why Embedded Linux" www.linuxdevices.com.
Rusling, The Linux Kernel 1999.
Lehrbaum, "Why Linux" Jan. 2000.
Lehrbaum, "why Linux" Feb. 2000.
"Linux Kernel Glossary," entry for ZFOD (zero-fill-on-demand), http://www.kernelnewbies.org/glossary, downloaded Feb. 22, 2006.
Paul Virgo, Embedded PC's for the Industrial Marketplace: An Analysis of the STD Bus, WESCON/'93. Conference Record, Sep. 28-30, 1993, pp. 621-623.
Jahn Luke et al., A commercial off-the-shelf based replacement strategy for aging avionics computers, Aerospace and Electronics Conference, 1998. NAECON 1998, Proceedings of the IEEE 1998 National, Jul. 13-17, 1998, pp. 177-181.
Get Control, Inc., PC-104 DIG-10-48 Plus, http://www.getcontrol.com downloaded from the internet on mar. 20, 2003, p. 1.
D. Powell et al., GUARDS: a generic upgradable architecture for real-time dependable systems, Parallel and Distributed Systems, IEEE Transactions on, vol. 10, Issue: 6, Jun. 1999, pp. 580-599.
Robert A. Burckle, PC/104 Embedded Modules: The New Systems Components, http://www.winsystems.com/papers/sys_components.pdf downloaded from the internet on Mar. 20, 2003, pp. 1-3.
WinSystems, www.winsystems.com downloaded from the internet on Apr. 2, 2003, pp. 1-25.
Jim Blazer, PC/104 Intelligente Data Acquisition, PC Embedded Solutions (Spring 1998), pp. 1-2.
Robert A. Burckle, STD Bus: Performance without Complexity, http://www.winsystems.com/papers/stdperformance.pdf (Aug. 1, 2001), pp. 1-3.
Craig Matasumoto, Intel starts preaching about security, EE Times http://eetimes.com/story/OEG1990121S0014 (Jan. 21, 1999), pp. 1-4.
Office Action mailed Aug. 2, 2002 from corresponding U.S. Appl. No. 09/520,405.
Office Action mailed Mar. 20, 2003 from corresponding U.S. Appl. No. 09/520,405.
Office Action mailed Sep. 8, 2003 from corresponding U.S. Appl. No. 09/520,405.
Office Action mailed Sep. 3, 2006 from corresponding U.S. Appl. No. 09/520,405.
Final Office Action mailed Dec. 20, 2005from corresponding U.S. Appl. No. 09/520,405.
Office Action mailed Jul. 14, 2006 from corresponding U.S. Appl. No. 09/520,405.
Office Action mailed Sep. 13, 2007 from corresponding U.S. Appl. No. 09/520,405.
International Preliminary Examination Report for PCT/US01/07447 (Dec. 23, 2004).
International Search Reports for applications PCT/US01/07447, PCT/US01/07381, and PCT/US02/30286.
Copy of PCT Search Report for PCT/US01/07447 mailed on Jun. 12, 2001 (6 pgs).
History of GSA, Web page [online]. Gaming Standards Association, 1997 [retrieved on Aug. 7, 2007] from the internet: 1 page. <http:/www.gamingstands.com/index.php?page=what_is_gsa/history_of_gas>.
Value proposition, Web page [online]. Gaming Standards Association, 1997 [retrieved on Aug. 7, 2007] from the internet: 2 pages. <http:/www.gamingstands.com/index.php?page=what_is_gsa/value_proposition> .
Office Action mailed Nov. 22, 2005 from corresponding U.S. Appl. No. 10/182, 469.
Office Action mailed Aug. 14, 2007 from corresponding U.S. Appl. No. 10/182, 469.
Office Action mailed Jun. 17, 2005 from corresponding U.S. Appl. No. 10/241,804.
Final Office Action mailed Mar. 9, 2006 from corresponding U.S. Appl. No. 10/241,804.
Office Action mailed May 31, 2007 from corresponding U.S. Appl. No. 10/241,804.

* cited by examiner

COMPUTERIZED GAMING SYSTEM, METHOD AND APPARATUS

NOTICE OF CO-PENDING APPLICATIONS

This application is a divisional of application Ser. No. 09/520,405, filed Mar. 8, 2000 and is related to co-pending application Ser. No. 09/405,921 filed Sep. 24, 1999, and to co-pending application Ser. No. 09/520,405, filed Mar. 8, 2000, which are hereby incorporated by reference.

FIELD OF THE INVENTION

The invention relates generally to computerized gaming systems, and more specifically to a game code and operating system method and apparatus for use within computerized gaming systems.

BACKGROUND OF THE INVENTION

Games of chance have been enjoyed by people for thousands of years and have enjoyed increased and widespread popularity in recent times. As with most forms of entertainment, players enjoy playing a wide variety of games and new games. Playing new games adds to the excitement of "gaming." As is well known in the art and as used herein, the term "gaming" and "gaming devices" are used to indicate that some form of wagering is involved, and that players must make wagers of value, whether actual currency or some equivalent of value, e.g., token or credit.

One popular game of chance is the slot machine. Conventionally, a slot machine is configured for a player to wager something of value, e.g., currency, house token, established credit or other representation of currency or credit. After the wager has been made, the player activates the slot machine to cause a random event to occur. The player wagers that particular random events will occur that will return value to the player. A standard device causes a plurality of reels to spin and ultimately stop, displaying a random combination of some form of indicia, for example, numbers or symbols. If this display contains one of a pre-selected plurality of winning combinations, the machine releases money into a payout chute or increments a credit meter by the amount won by the player. For example, if a player initially wagered two coins of a specific denomination and that player achieved a payout, that player may receive the same number or multiples of the wager amount in coins of the same denomination as wagered.

There are many different formats for generating the random display of events that can occur to determine payouts in wagering devices. The standard or original format was the use of three reels with symbols distributed over the face of the wheel. When the three reels were spun, they would eventually each stop in turn, displaying a combination of three symbols (e.g., with three wheels and the use of a single payout line as a row in the middle of the area where the symbols are displayed). By appropriately distributing and varying the symbois on each of the reels, the random occurrence of predetermined winning combinations can be provided in mathematically predetermined probabilities. By clearly providing for specific probabilities for each of the pre-selected winning outcomes, precise odds that would control the amount of the payout for any particular combination and the percentage return on wagers for the house could be readily controlled.

Other formats of gaming apparatus that have developed in a progression from the pure slot machine with three reels have dramatically increased with the development of video gaming apparatus. Rather than have only mechanical elements such as wheels or reels that turn and stop to randomly display symbols, video gaming apparatus and the rapidly increasing sophistication in hardware and software have enabled an explosion of new and exciting gaming apparatus. The earlier video apparatus merely imitated or simulated the mechanical slot games in the belief that players would want to play only the same games. Early video games therefore were simulated slot machines. The use of video gaming apparatus to play new games such as draw poker and Keno broke the ground for the realization that there were many untapped formats for gaming apparatus. Now casinos may have hundreds of different types of gaming apparatus with an equal number of significant differences in play. The apparatus may vary from traditional three reel slot machines with a single payout line, video simulations of three reel video slot machines, to five reel, five column simulated slot machines with a choice of twenty or more distinct paylines, including randomly placed lines, scatter pays, or single image payouts. In addition to the variation in formats for the play of games, bonus plays, bonus awards, and progressive jackpots have been introduced with great success. The bonuses may be associated with the play of games that are quite distinct from the play of the original game, such as the video display of a horse race with "bets" on the individual horses randomly assigned to players that qualify for a bonus, the spinning of a random wheel with fixed amounts of a bonus payout on the wheel (or simulation thereof), or attempting to select a random card that is of higher value than a card exposed on behalf of a virtual "dealer."

Examples of such gaming apparatus with a distinct bonus feature includes U.S. Pat. Nos. 5,823,874; 5,848,932; 5,836,041; U.K. Patent Nos. 2 201 821 A; 2 202 984 A; and 2 072 395A; and German Patent DE 40 14 477 A1. Each of these patents differ in fairly subtle ways as to the manner in which the bonus round is played. British patent 2 201 821 A and DE 37 00 861 A1 describe a gaming apparatus in which after a winning outcome is first achieved in a reel-type gaming segment, a second segment is engaged to determine the amount of money or extra games awarded. The second segment gaming play involves a spinning wheel with awards listed thereon (e.g., the number of coins or number of extra plays) and a spinning arrow that will point to segments of the wheel with the values of the awards thereon. A player will press a stop button and the arrow will point to one of the values. The specification indicates both that there is a level of skill possibly involved in the stopping of the wheel and the arrow(s), and also that an associated computer operates the random selection of the rotatable numbers and determines the results in the additional winning game, which indicates some level of random selection in the second gaming segment.

U.S. Pat. Nos. 5,823,874 and 5,848,932 describe a gaming device comprising: a first, standard gaming unit for displaying a randomly selected combination of indicia, said displayed indicia selected from the group consisting of reels, indicia of reels, indicia of playing cards, and combinations thereof; means for generating at least one signal corresponding to at least one select display of indicia by said first, standard gaming unit; means for providing at least one discernible indicia of a mechanical bonus indicator, said discernible indicia indicating at least one of a plurality of possible bonuses, wherein said providing means is operatively connected to said first, standard gaming unit and becomes actuatable in response to said signal. In effect, the second gaming event simulates a mechanical bonus indicator such as a roulette wheel or wheel with a pointing element.

A video terminal is another form of gaming device. Video terminals operate in the same manner as a conventional slot and video machine, except that a redemption ticket rather than an immediate payout is dispensed.

The vast array of electronic video gaming apparatus that is commercially available is not standardized within the industry or necessarily even within the commercial line of apparatus available from a single manufacturer. One of the reasons for this lack of uniformity or standardization is the fact that the operating systems that have been used to date in the industry are primitive. As a result, the programmer must often create code for each and every function performed by each individual apparatus.

Attempts have been made to create a universal gaming engine for a gaming machine and is described in Carlson U.S. Pat. No. 5,707,286. This patent describes a universal gaming engine that segregates the random number generator and transform algorithms so that this code need not be rewritten or retested with each new game application. All code that is used to generate a particular game is contained in a rule EPROM in the rules library 108. Although the step of segregating random number generator code and transform algorithms has reduced the development time of new games, further improvements are needed.

One significant economic disadvantageous feature with commercial video wagering gaming units that maintains an artificially high price for the systems in the market is the use of unique hardware interfaces in the various manufactured video gaming systems. The different hardware, the different access codes, the different pin couplings, the different harnesses for coupling of pins, the different functions provided from the various pins, and the other various and different configurations within the systems has prevented any standard from developing within the technical field. This is advantageous to the equipment manufacturer, because the games for each system are provided exclusively by a single manufacturer, and the entire systems can be readily obsoleted, so that the market will have to purchase a complete unit rather than merely replacement software, and aftermarket game designers cannot easily provide a single game that can be played on different hardware.

The invention of computerized gaming systems that include a common or "universal" video wagering game controller that can be installed in a broad range of video gaming apparatus without substantial modification to the game controller has made possible the standardization of many components and of corresponding gaming software within gaming systems. Such systems desirably will have functions and features that are specifically tailored to the unique demands of supporting a variety of games and gaming apparatus types, and doing so in a manner that is efficient, secure, and cost-effective to operate.

What is desired is an architecture and method providing a gaming-specific platform that features reduced game development time and efficient game operation, provides security for the electronic gaming system, and does so in a manner that is cost-effective for game software developers, gaming apparatus manufacturers, and gaming apparatus users. An additional advantage is that the use of the platform will speed the review and approval process for games with the various gaming agencies, bringing the games to market sooner.

SUMMARY OF THE INVENTION

The present invention in various embodiments provides a computerized wagering game method and apparatus that features an operating system kernel that may include selected device handlers that are disabled or removed. The present invention features a system handler application that is part of the operating system. The system handles loads and executes gaming program objects and features nonvolatile storage that facilitates sharing of information between gaming program objects. The system handler of some embodiments further provides an API library of functions callable from the gaming program shared objects, and facilitates the use of callback functions on change of data stored in nonvolatile storage. A nonvolatile record of the state of the computerized wagering game is stored on the nonvolatile storage, providing protection against loss of the game state due to power loss. The system handler application in various embodiments includes a plurality of handlers, providing an interface to selected hardware and the ability to monitor hardware-related events.

DETAILED DESCRIPTION

Figure 1:
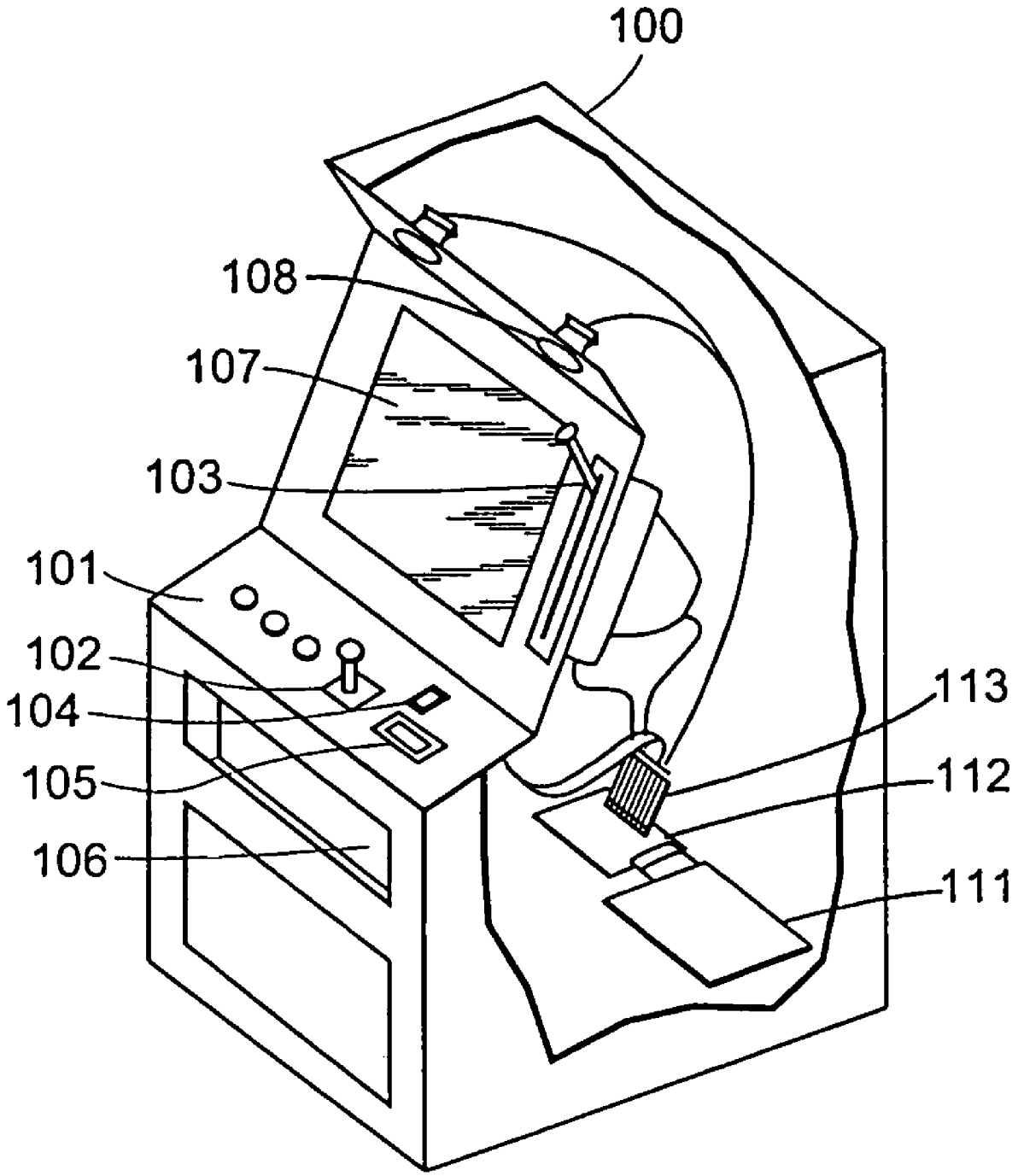
FIG. 1 shows a computerized wagering game apparatus as may be used to practice an embodiment of the present invention.

In the following detailed description of sample embodiments of the invention, reference is made to the accompanying drawings which form a part hereof, and in which is shown by way of illustration specific sample embodiments in which the invention may be practiced. These embodiments are described in sufficient detail to enable those skilled in the art to practice the invention, and it is to be understood that other embodiments may be utilized and that logical, mechanical, electrical, and other changes may be made without departing from the spirit or scope of the present invention. The following detailed description is, therefore, not to be taken in a limiting sense, and the scope of the invention is defined only by the appended claims.

Definitions

For purposes of this disclosure, the following terms have specialized meaning, and are defined below:

"Memory" for purposes of this disclosure is defined as any type of media capable of read/write capability. Examples of memory are RAM, tape and floppy disc.

"Shared Objects" for purposes of this disclosure are defined as self-contained, functional units of game code that define a particular feature set or sequence of operation for a game. The personality and behavior of a gaming machine of the present invention are defined by the particular set of shared objects called and executed by the operating system. Within a single game, numerous shared objects may be dynamically loaded and executed. This definition is in contrast with the conventional meaning of a shared object, which typically provides an API to multiple programs.

"Architecture" for purposes of this disclosure is defined as software, hardware or both.

"Dynamic Linking" for purposes of this disclosure is defined as linking at run time.

"API" for purposes of this disclosure is an Application Programming Interface. The API includes a library of functions.

"System Handler" for purposes of this disclosure is defined as a collection of code written to control non-game specific device handlers. Examples of device handlers include I/O, sound, video, touch screen, nonvolatile RAM and network devices.

"Gaming Data Variables" for purposes of this disclosure includes at a minimum any or all data needed to reconstruct the game state in the event of a power loss.

"Game.State File" for purposes of this disclosure is a template for creating a look-up list of information stored in NV RAM.

The present invention provides a computerized gaming system method and apparatus that have novel gaming-specific features that improve security, make development of game code more efficient, and do so using an apparatus and software methods that are cost-effective and efficient. The present invention also reduces the amount of effort required to evaluate and review new game designs by gaming regulators, because the amount of code to be reviewed for each game is reduced by as much as 80% over known, machine-specific architecture. The invention provides, in various embodiments, features such as a nonvolatile memory for storing gaming application variables and game state information, provides a shared object architecture that allows individual game objects to be loaded and to call common functions provided by a system handler application, and in one embodiment provides a custom operating system kernel that has selected device handlers disabled.

FIG. 1 shows an exemplary gaming system 100, illustrating a variety of components typically found in gaming systems and how they may be used in accordance with the present invention. User interface devices in this gaming system include push buttons 101, joystick 102, and pull arm 103. Credit for wagering may be established via coin or token slot 104, a device 105 such as a bill receiver or card reader, or any other credit input device. A card reader 105 may also provide the ability to record credit information on a user's card when the user has completed gaming, or credit may be returned via a coin tray 106 or other credit return device. Information is provided to the user by devices such as video screen 107, which may be a cathode ray tube (CRT), liquid crystal display (LCD) panel, plasma display, light-emitting diode (LED) display, mechanical reels or wheels or other display device that produces a visual image under control of the computerized game controller. Also, buttons 101 may be lighted to indicate what buttons may be used to provide valid input to the game system at any point in the game. Still other lights or other visual indicators may be provided to indicate game information or for other purposes such as to attract the attention of prospective game users. Sound is provided via speakers 108, and also may be used to indicate game status, to attract prospective game users, to provide player instructions or for other purposes, under the control of the computerized game controller.

The gaming system 100 further comprises a computerized game controller 111 and I/O interface 112, connected via a wiring harness 113. The universal game controller 111 need not have its software or hardware designed to conform to the interface requirements of various gaming system user interface assemblies, but can be designed once and can control various gaming systems via the use of machine-specific I/O interfaces 112 designed to properly interface an input and/or output of the universal computerized game controller to the harness assemblies found within the various gaming systems.

In some embodiments, the universal game controller 111 is a standard IBM Personal Computer-compatible (PC compatible) computer. Still other embodiments of a universal game controller comprise general purpose computer systems such as embedded controller boards or modular computer systems. Examples of such embodiments include a PC compatible computer with a PC/104 bus that is an example of a modular computer system that features a compact size and low power consumption while retaining PC software and hardware compatibility. The universal game controller 111 provides all functions necessary to implement a wide variety of games by loading various program code on the universal controller, thereby providing a common platform for game development and delivery to customers for use in a variety of gaming systems. Other universal computerized game controllers consistent with the present invention may include any general-purpose computers that are capable of supporting a variety of gaming system software, such as universal controllers optimized for cost effectiveness in gaming applications or that contain other special-purpose elements yet retain the ability to load and execute a variety of gaming software. Examples of special purpose elements include elements that are heat resistant and are designed to operate under less than optimal environments that might contain substances such as dust, smoke, heat and moisture. Special purpose elements are also more reliable when used 24 hours per day, as is the case with most gaming applications.

The computerized game controller of some embodiments is a computer running an operating system with a gaming application-specific kernel. In further embodiments, a game engine layer of code executes within a non-application specific kernel, providing common game functionality. The gaming program shared object in such embodiments is therefore only a fraction of the total code, and relies on the game engine layer and operating system kernel to provide a library of gaming functions. A preferred operating system kernel is the public domain Linux 2.2 kernel available on the Internet. Still other embodiments will have various levels of application code, ranging from embodiments containing several layers of game-specific code to a single-layer of game software running without an operating system or kernel but providing its own computer system management capability.

Figure 2:
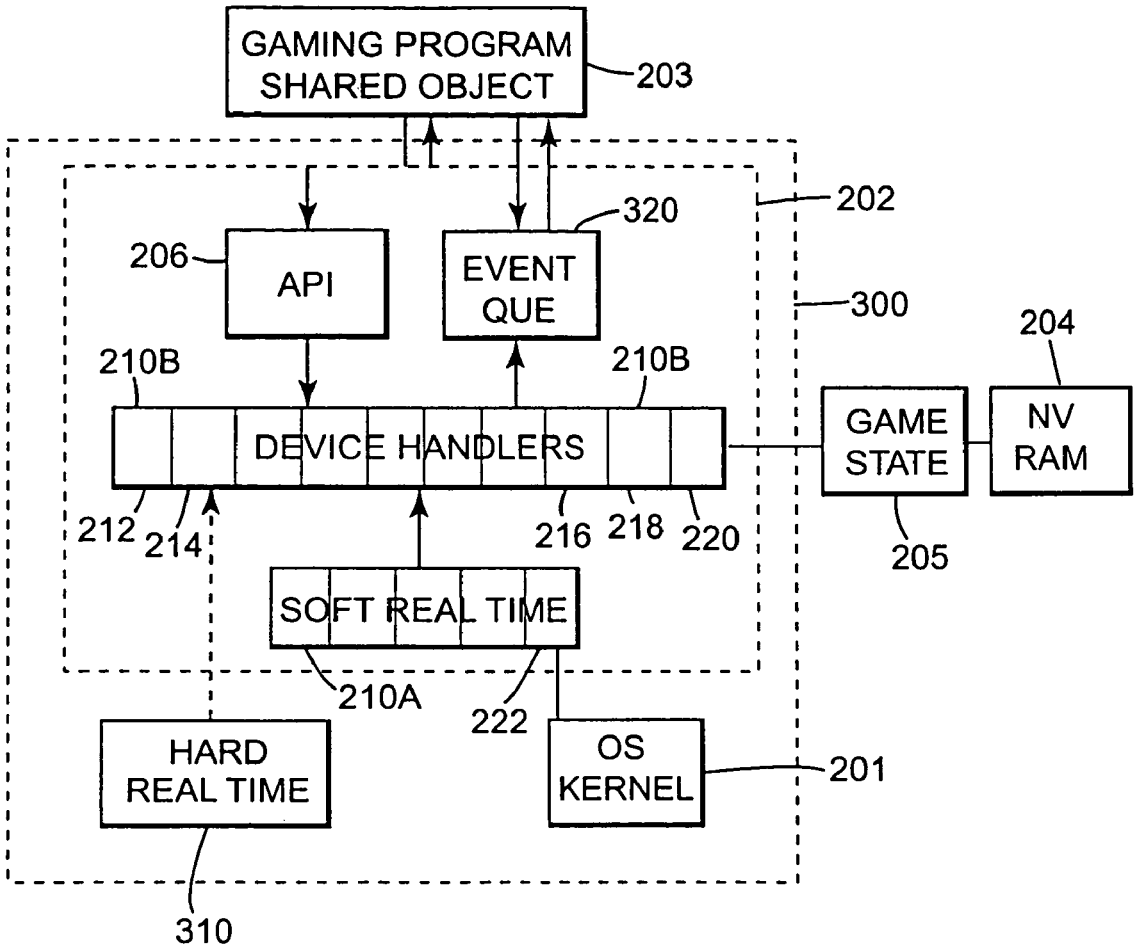
FIG. 2 shows a more detailed structure of program code executed on a computerized wagering game apparatus, consistent with an embodiment of the present invention.

FIG. 2 illustrates the structure of one exemplary embodiment of the invention, as may be practiced on a computerized gaming system such as that of FIG. 1. The invention includes an operating system 300, including an operating system kernel 201 and a system handler application 202. An operating system kernel 201 is first executed, after which a system handler application 202 is loaded and executed. The system handler application in some embodiments may load a gaming program shared object 203, and may initialize the game based on gaming data variables stored in nonvolatile storage 204. In some embodiments, the gaming data variables are further loaded into a Game.State data file or other data storage device 205, which reflects the data stored in nonvolatile storage 204. The nonvolatile RAM (NV-RAM) according to the invention has read/write capability. The gaming program object in some embodiments calls separate API functions 206, such as sound functions that enable the gaming apparatus to produce sound effects and music.

The OS kernel 201 in some embodiments may be a Linux kernel, but in alternate embodiments may be any other operating system providing a similar function. The Linux 2.2 operating system kernel in some further embodiments may be modified for adaptation to gaming architecture. Modifications may comprise erasing or removing selected code from the kernel, modifying code within the kernel, adding code to the kernel or performing any other action that renders the device handler code inoperable in normal kernel operation. By modifying the kernel in some embodiments of the invention, the function of the computerized gaming apparatus can be enhanced by incorporating security features, for example. In an embodiment, all modifications to the kernel are modular.

For example, as described in my co-pending application Ser. No. 10/182,534, entitled "Encryption in a Secure Computerized Gaming System" filed on the same date as the present application, several functions are incorporated into the kernel to verify that the operating system and shared object code have not changed, and that no new code has been incorporated into the operating system code or shared object code.

In one embodiment, the kernel is modified so that it executes user level code out of ROM. The use of the Linux operating system lends itself to this application because the source code is readily available. Other operating systems such as Windows and DOS are other suitable operating systems.

Embodiments of the invention include hard real time code 310 beneath the kernel providing real time response such as fast response time to interrupts. The hard real time code 310 is part of the operating system in one embodiment.

In an embodiment of the invention, all user interface peripherals such as keyboards, joysticks and the like are not connected to the architecture so that the operating system and shared objects retain exclusive control over the gaming machine. In another embodiment, selected device handlers are disabled so that the use of a keyboard, for example, is not possible. It is more desirable to retain this functionality so that user peripherals can be attached to service the machine. It might also be desirable to attach additional user peripherals such as tracking balls, light guns, light pens and the like.

In another embodiment, the kernel is modified to zero out all unused RAM. This function eliminates code that has been inserted unintentionally, such as through a Trojan horse, for example.

In one embodiment, the kernel and operating system are modified to hash the system handler and shared object or gaming program object code, and to hash the kernel code itself. These functions in different embodiments are performed continuously, or at a predetermined frequency.

The system handler application is loaded and executed after loading the operating system, and manages the various program shared objects. In further embodiments, the system handler application provides a user Application Program Interface (API) 206, that includes a library of operating functions used by one or more of the program shared objects and device handlers shown generally at 203 and 210. For example, the API in one embodiment includes functions that control graphics, such as color, screen commands, font settings, character strings, 3-D effects, etc. The device handlers and shared objects 210 are preferably handled by an event queue 320. The event queue schedules the event handlers in sequence. One of the shared objects 203 calls the APIs 206 in one embodiment. The system handler application 202 in various embodiments also manages writing of data variables to the "game.state" file 205 stored in the nonvolatile storage 204, and further manages calling any callback functions associated with each data variable changed.

The system handler 202 application of some embodiments may manage the gaming program shared objects by loading a single object at a time and executing the object. When another object needs to be loaded and executed, the current object may remain loaded or can be unloaded and the new object loaded in its place before the new object is executed. The various shared objects can pass data between objects by storing the data in nonvolatile storage 204, utilizing a game.state data storage device 205. For example, a "game.so" file may be a gaming program object file that is loaded and executed to provide operation of a feature set of a computerized wagering game, as a "bonus.so" gaming program object file is loaded and executed to provide a feature set of the bonus segment of play. Upon changing from normal game operation to bonus, the bonus.so is loaded and executed upon loading. Because the relevant data used by each gaming program object file in this example is stored in nonvolatile storage 204, the data may be accessed as needed by whatever gaming program object is currently loaded and executing.

The system handler application in some embodiments provides an API that comprises a library of gaming functions, enabling both easy and controlled access to various commonly used functions of the gaming system. Providing a payout in the event of a winning round of game play, for example, may be accomplished via a payout function that provides the application designer's only access to the hardware that pays out credit or money. Restrictions on the payout function, such as automatically reducing credits stored in nonvolatile storage each time a payout is made, may be employed in some embodiments of the invention to ensure proper and secure management of credits by the computerized gaming system. The functions of the API may be provided by the developer as part of the system handler application, and may be a part of the software provided in the system handler application package. The API functions may be updated as needed by the provider of the system handler application to provide new gaming functions as desired. In some embodiments, the API may simply provide functions that are commonly needed in gaming, such as computation of odds or random numbers, an interface to peripheral devices, or management of cards, reels, video output or other similar functions.

The system handler application 202 in various embodiments also comprises a plurality of device handlers 210, that monitor for various events and provide a software interface to various hardware devices. For example, some embodiments of the invention have handlers for nonvolatile memory 212, one or more I/O devices 214, a graphics engine 216, a sound device 218, or a touch screen 220. Also, gaming-specific devices such as a pull arm, credit receiving device or credit payout device may be handled via a device handler 222. Other peripheral devices may be handled with similar device handlers, and are to be considered within the scope of the invention. In one embodiment, the device handlers are separated into two types. The two types are: soft real time 210A and regular device handlers 210B. The two types of device handlers operate differently. The soft real time handler 210A constantly runs and the other handler 210B runs in response to events.

The nonvolatile storage 204 used to store data variables may be a file on a hard disc, may be nonvolatile memory, or may be any other storage device that does not lose the data stored thereon upon loss of power. In one embodiment the nonvolatile storage in battery-backed RAM. The nonvolatile storage in some embodiments may be encrypted to ensure that the data variables stored therein cannot be corrupted. Some embodiments may further include a game.state file 205, which provides a look-up table for the game data stored in nonvolatile storage 204. The game.state file is typically parsed prior to execution of the shared object file. The operating system creates a map of NVRAM by parsing the game.state file. The look-up table is stored in RAM. This look-up table is used to access and modify game data that resides in NVRAM 204. This game data can also be stored on other types of memory.

In some embodiments, a duplicate copy of the game data stored in NVRAM 204 resides at another location in the NVRAM memory. In another embodiment, a duplicate copy of the game data is copied to another storage device. In yet another embodiment, two copies of the game data reside on the NVRAM and a third copy resides on a separate storage device. In yet another embodiment, three copies of the game data reside in memory. Extra copies of the game data are required by gaming regulations in some jurisdictions.

Data written to the game state device must also be written to the nonvolatile storage device, unless the game state data device is also nonvolatile, to ensure that the data stored is not lost in the event of a power loss. For example, a hard disc in one embodiment stores a game.state file that contains an unencrypted and nonvolatile record of the encrypted data variables in nonvolatile storage flash programmable memory (not shown). Data variables written in the course of game operation are written to the game.state file, which may be encrypted and stored in the nonvolatile storage 204, upon normal shutdown. Loss of power leaves a valid copy of the most recent data variables in the game.state file, which may be used in place of the data in NVRAM in the event of an abnormal shutdown.

In an alternate embodiment, a game state device 205 such as a game.state file stored on a hard disc drive provides variable names or tags and corresponding locations in nonvolatile storage 204, in effect, providing a variable map of the nonvolatile storage. In one such embodiment, the nonvolatile storage may then be parsed using the data in the game state file 205, which permits access to the variable name associated with a particular nonvolatile storage location. Such a method permits access to and handling of data stored in nonvolatile storage using variable names stored in the game state file 205, allowing use of a generic nonvolatile storage driver where the contents of the nonvolatile storage are game-specific. Other configurations of nonvolatile storage such as a single nonvolatile storage are also contemplated, and are to be considered within the scope of the invention.

Callback functions that are managed in some embodiments by the system handler application 202 are triggered by changing variables stored in NVRAM 204. For each variable, a corresponding function may be called that performs an action in response to the changed variable. For example, every change to a "credits" variable in some embodiments calls a "display_credits" function that updates the credits as displayed to the user on a video screen. The callback function may be a function provided by the current gaming program shared object or can call a different gaming program object.

The gaming program's shared objects in some embodiments of the invention define the personality and function of the game. Program objects provide different game functions, such as bookkeeping, game operation, game setup and configuration functions, bonus displays and other functions as necessary. The gaming program objects in some embodiments of the invention are loaded and executed one at a time, and share data only through NVRAM 204 or another game data storage device. The previous example of unloading a game.so gaming program object and replacing it with a bonus.so file to perform bonus functions is an example of such use of multiple gaming program shared objects.

Each gaming program object may require certain game data to be present in NVRAM 204, and to be usable from within the executing gaming program shared object 203. The game data may include meter information for bookkeeping, data to recreate game on power loss, game history, currency history, credit information, and ticket printing history, for example. These files do not include operable code or functions.

The operating system of the present application is not limited to use in gaming machines. It is the shared object library rather than the operating system itself that defines the personality and character of the game. The operating system of the present invention can be used with other types of shared object libraries for other purposes.

For example, the operating system of the present invention can be used to control networked on-line systems such as progressive controllers and player tracking systems. The operating system could also be used for kiosk displays or for creating "picture in picture" features in gaming machines. A gaming machine could be configured so that a video slot player could place a bet in the sports book, then watch the sporting event in the "picture in picture" feature while playing his favorite slot game.

The present invention provides a computerized gaming apparatus and method that provides a gaming-specific platform that features reduced game development time and efficient game operation via the use of a system handler application that can manage independent gaming program objects and gaming-specific API, provides game functionality to the operating system kernel, provides security for the electronic gaming system via the nonvolatile storage and other security features of the system, and does so in an efficient manner that makes development of new software games relatively easy. Production and management of a gaming apparatus is also simplified, due to the system handler application API library of gaming functions and common development platform provided by the invention.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the invention. It is intended that this invention be limited only by the claims, and the full scope of equivalents thereof.

What is claimed is:

1. A universal operating system stored in a memory of a computerized controller comprising a processor with said memory and the operating system stored in said memory, the controller further comprising a operating state storage, a nonvolatile storage, the computerized controller being operable to control at least one computerized wagering game, the operating system comprising:

an operating system kernel and a system handler application, the operating system kernel and system handler application operable to dynamically link with a plurality of program shared objects and device handlers and load said program shared objects and device handlers, wherein said plurality of program shared objects can be effectively shared between two or more computerized wagering games;

the system handler application further comprising an event queue;

the system handler application further comprising an Application Program Interface (API) comprising functions callable from the program shared objects, the Application Program Interface comprising a plurality of operating functions callable by and used by said plurality of said program shared objects;

the device handlers accessing a look-up table in the operating state storage for the data variables stored in the nonvolatile storage;

the system handler application operable to: initiate execution of a computerized wagering game based on data variables stored in the nonvolatile storage; write data variables to the nonvolatile storage when said computerized wagering game is executed; and wherein said writing of said data variables changes the data variables in the nonvolatile storage and consequently causes execution of a corresponding callback function in one of the plurality of program shared objects of the system handler application.

2. The universal operating system of claim 1, wherein the system handler application further comprises an event handler.

3. The universal operating system of claim 1, wherein the system handler application comprises software having the ability when executed to:

unload a previous program shared object or device handler if a previous object or device handler has been loaded;

load a new program shared object or device handler; and execute the new program shared object or device handler.

4. The universal operating system of claim 1, wherein data variables modified by the program shared objects are stored by the system handler application in the nonvolatile storage and the operating state storage, and the system handler application functions to verify that the operating system or code for a shared object has not changed.

5. The universal operating system of claim 4 wherein the operating state storage provides a variable name index to associated variable data locations within the nonvolatile storage.

6. The universal operating system of claim 1, further comprising a plurality of APIs.

7. The universal operating system of claim 1, wherein the operating system kernel is a Linux operating system kernel.

8. The universal operating system of claim 7, wherein the Linux operating system kernel has at least one selected device handler disabled.

9. The universal operating system of claim 8, wherein the at least one selected device handler that is disabled is selected from the group consisting of a keyboard handler, an I/O port handler, a network interface handler, a storage device controller handler, and a I/O device handler.

10. The universal operating system of claim 9, wherein the system handler application and the operating system kernel work in communication to hash system handler application code and operating system kernel code.

11. The universal operating system of claim 1 wherein the operating system is controlled by a general-purpose computer and the nonvolatile storage stores program variables, such that loss of power does not result in loss of the state of the computerized wagering game system, and the system handler application loads a first shared object and the first shared object calls up a function from within an Application Program Interface.

12. The universal operating system of claim 11 wherein the system application handler loads and executes a single shared object at any one time but other shared objects are operable to share data via the program variables stored in nonvolatile storage.

13. A method of managing data in a universal operating system via a system handler application, the method comprising:

(a) executing an operating system includeing system kernel and a system handler application, both the operating system kernel and system handler application operable to dynamically link with a plurality of program shared objects and device handlers and load said shared objects and device handlers, wherein said plurality of shared objects can be effectively shared between two or more programs, the system handler application comprising an Application Program Interface comprising a plurality of functions callable from at least some of the shared objects, the system handler application operable to initiate a game based on data variables stored in a nonvolatile storage and the system handler application operable to write data variables to one of the nonvolatile storage or an operating state storage, the operating state storage comprising a look-up table for data variables stored in the nonvolatile storage, (b) the system handler application loading a first shared object and providing Application Program Interface functions called by the first shared object;

(c) the system handler application executing the first shared object; and (d) the system handler application storing data variables in the nonvolatile storage, such that a second shared object later or a first device handler loaded can access the data variables in nonvolatile storage by utilizing the look-up table of the operating state storage.

14. A computer readable medium storing computer program code for managing data in a universal operating system via a system handler application, the computer readable medium comprising:

computer program code for executing an operating system which then loads and operates an operating system kernel and a system handler application, both the operating system kernel and system handler application operable to dynamically link with a plurality of program shared objects and device handlers and load said shared objects and device handlers, wherein said plurality of shared objects can be effectively shared between two or more programs, the system handler application comprising an Application Program Interface comprising a plurality of functions callable from at least some of the shared objects, the system handler application operable to: initiate a game based on data variables stored in a nonvolatile storage and write data variables to one the nonvolatile storage, wherein said writing of the data variables changes data variables in the nonvolatile storage and consequently causes execution of a corresponding callback function in one of the plurality of program shared objects of the system handler application.

* * * * *